US006871037B1

(12) United States Patent
Pierel et al.

(10) Patent No.: US 6,871,037 B1
(45) Date of Patent: Mar. 22, 2005

(54) METHOD FOR CALIBRATING OR RECALIBRATING A CONVERSION FACTOR FOR DETERMINING THE DISTANCE COVERED BY A PRINT SUBSTRATE IN A PRINTING MACHINE

(75) Inventors: Frank Pierel, Kiel (DE); Jan Dirk Boness, Bad Bramstedt (DE); Heiko Hunold, Wattenbek (DE)

(73) Assignee: NexPress Solutions LLC, Rochester, NY (US)

( * ) Notice: Subject to any disclaimer, the term of this patent is extended or adjusted under 35 U.S.C. 154(b) by 114 days.

(21) Appl. No.: 10/406,747

(22) Filed: Apr. 3, 2003

(30) Foreign Application Priority Data

Apr. 8, 2002 (DE) ..... 102 15 313
Dec. 3, 2002 (DE) ..... 102 56 303

(51) Int. Cl.[7] ..... G03G 15/00
(52) U.S. Cl. ..... 399/303; 399/301
(58) Field of Search ..... 399/303, 38, 75, 399/78, 313, 301, 394; 358/504, 406

(56) References Cited

U.S. PATENT DOCUMENTS

2001/0043823 A1 * 11/2001 Metzler et al. ..... 399/301

FOREIGN PATENT DOCUMENTS

JP 2001-066948 * 3/2001

* cited by examiner

*Primary Examiner*—Sophia S. Chen
(74) *Attorney, Agent, or Firm*—Lawrence P. Kessler

(57) ABSTRACT

A method for the calibration or recalibration of a conversion factor (web encoder resolution), used to determine the distance covered by a print substrate in a printing machine, in particular an electrophotographically operating printing machine, by the cycles of a rotary input type of encoder (web encoder) which sends a signal to the driver of the conveyor belt, preferably the rotation of a rotating drive component for the conveyor belt. This task is solved in that the number of phase pulse signals of the rotary input type of encoder which accumulates during the movement over the dimensions of the longitudinal extension known or otherwise measured section of the conveyer belt, is determined and compared to the known dimensions of the longitudinal extension.

3 Claims, 2 Drawing Sheets

METHOD FOR CALIBRATING OR RECALIBRATING A CONVERSION FACTOR FOR DETERMINING THE DISTANCE COVERED BY A PRINT SUBSTRATE IN A PRINTING MACHINE

FIELD OF THE INVENTION

The invention relates to a method for the calibration or recalibration of a conversion factor (web encoder resolution), used to determine the distance covered by a print substrate in a printing machine, in particular an electrophotographically operating printing machine, by means of the cycles of a rotary input type of encoder (web encoder) which sends a signal to the driver of the conveyor belt, preferably the rotation of a rotating drive component for the conveyor belt.

BACKGROUND OF THE INVENTION

For a printing process, in particular with an electrographically operating printing machine, where an imaging drum is newly illustrated or each printing process, meaning that the printing takes place without a permanent printing form (so-called non impact printing), a path in the transfer direction (intrack) of a print substrate must be determined for the various requirements. In particular, one of the quality characteristics of a print is how exactly the length of a printed image on the print substrate (actual length), preferably on a sheet, matches the desired image length (target length) in the transfer direction of the print substrate. This can take place according to the method mentioned previously by using the signals of the rotary input type of encoder, whereby the conveyor belt is advanced according to a predetermined number of phase pulse signal distances, resulting in the desired distance, if it is determined previously by calibration or gauging how large the progressive movement section is that corresponds to a phase pulse signal distance and therefore how many of this type of progressive movement sections are required to attain the desired distance. A distance conversion factor (Web Encoder Resolution) must therefore be determined on the basis of a phase pulse signal distance of the rotary input type of encoder (Web Encoder).

Such a distance conversion factor must be determined with sufficient accuracy at least once for each printing machine, even for those of the same type.

The conventional procedure, for the previously mentioned image length, for example, is to print a test image on a print substrate, which marks a known distance as the image length on the print substrate. By measuring this distance on the basis of phase impulse signal distances of the rotary input type of encoder and comparing the corresponding measurement of a printed image in a printing product, a correction factor is calculated with which the distance conversion factor or also the transfer factor is adjusted in the software of the printing machine and thus calibrated in this manner. However, this known procedure is time-consuming.

SUMMARY OF THE INVENTION

The task of the invention is thus to present a method of the previously mentioned type that can be carried out with sufficient precision and which saves time and is preferably automated.

This task is solved according to the invention, in that the number of phase pulse signals of a rotating encoder are determined, which are accumulated during a movement of a section of the conveyor belt that is known in its longitudinal path or otherwise measured over the dimensions of its longitudinal distance and then compared and put into relation to the known longitudinal distance.

In this case, it is preferably envisaged that the number of rotary input type of encoder cycles that accumulate during a complete cycle of a conveyor belt forming a closed loop is determined and divided by the known or other measured total length of the conveyor belt.

It has been shown that for the method according to the invention, the length of the conveyor belt or of a section of it can be determined with sufficient precision and that it also remains sufficiently constant during the operation of the printing machine and its aging. Should the total length of the conveyor belt change in the course of time, this would automatically be taken into consideration during the calibration according to the invention that is carried out from time to time, since it would be discovered, of course, that now such a new calibration would result in a different number of phase impulse signal distances for a full cycle of the conveyor belt, and that this new, relative calibration of the progressive movement section must be compared with the earlier number of phase impulse signal distances for a cycle.

To execute exactly one complete cycle of the conveyor belt for calibration purposes, preferably a significant characteristic can be arranged or found as start and target marks, such as a marking on or in the conveyor belt; however, for example, an available interface used to form the closed loop of the conveyor belt by connecting the ends of the conveyor belt can also be taken with sufficient accuracy as such a mark, which, for example, based on the low transparency of the conveyor belt at this interface, could be recognized with an, optical sensor.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which only an exemplary explanation of the method according to the invention, in which the method according to the invention is not limited in its scope, is given below.

DETAILED DESCRIPTION OF THE INVENTION

Figure 1:
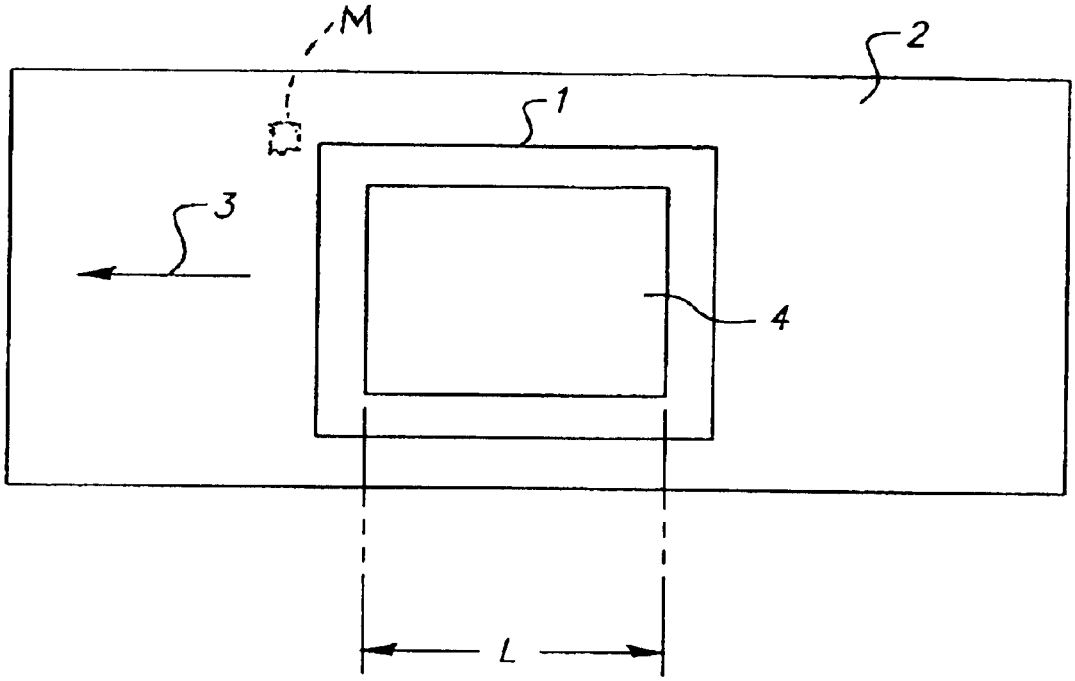
FIG. 1 is a top view of a section of a conveyor belt with a print substrate sheet.

FIG. 1 shows a top view of a sheet 1 of a print substrate on a conveyor belt 2, of which only a section is illustrated. The conveyor belt 2 carries the sheet 1 in the direction of the arrow 3. The conveyor belt forms a closed loop (FIG. 3) and runs in the direction 3 around deflecting pulleys or guide rollers. On the sheet 1, a printing image 4, such as a text with a corresponding print space or a graphical representation or a mixture of text and/or graphics and/or logo is printed with an overall length L. For this purpose the conveyor belt runs through a printing machine, preferably an electrophotographically operating printing machine that is not illustrated in greater detail, and, in the course of doing so, passes suitable printed matter that are likewise not shown in FIG. 1. In this case, it is important that the actually printed image length L, that runs in the transfer direction, corresponds exactly to a target print image length, whose printing, for example, is desired according to the requirements of an artwork mask. To this end, for example, in the case of an electrophotographically operating printing machine it must be ensured by means of suitable software that the image data to be printed, which, for example, has been previously transferred from the artwork mask (scanned in) has been used for images on the imaging drums to develop toner image color separations, whose image length L, which has been transferred onto the sheet 1 of the print substrate corresponds to the desired target image length. To this end, the software must provide a standard, which is based on a suitable scale unit, which must be calibrated for the respective printing machine and made available to the software or possibly also must be corrected from time to time.

Figure 2:
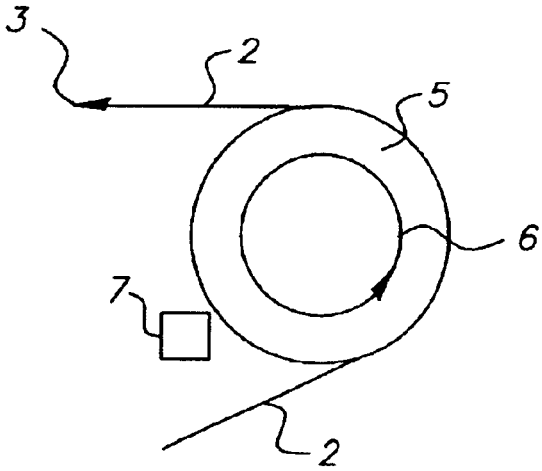
FIG. 2 is a schematic drawing of an area of the conveyor belt according to FIG. 1 circulating around a drive roller.

FIG. 2 shows a schematic lateral view of a section of the conveyor belt 2, which is moving in the transfer direction 3, with sheet 1 being carried in this manner in this direction. The conveyor belt 2 is driven in this case by a driving roller 5, which turns in the direction of an arrow 6 and which is partially wrapped around the conveyor belt 2 by friction engagement. The conveyor belt forms a closed loop, which is not shown in greater detail in FIG. 2, which runs over several guide rollers, and which, in order to generate the mentioned friction engagement on the driving rollers 5, can be stretched by means of the mentioned guide rollers.

A rotary input type of encoder 7 or an encoder is arranged in the area of the driving rollers, which is only schematically indicated. This rotary input type of encoder 7 thus emits, in accordance with the rotational positions of the driving rollers 5, rotation angle-related phase pulse signals. Within a timed phase impulse signal distance, the driving rollers 5 thus rotate further around a certain rotation angle and the conveyor belt 2 is further moved around a spatial progressive movement section in accordance with this rotation angle and the allocated circumferential section of the driving roller 5. This section of progressive movement of the conveyor belt during each phase impulse signal distance of the rotary input type of encoder is the appropriate dimensional unit for measuring the distance running in the transfer direction 3. The measured value of such a distance in this mentioned dimensional unit corresponds to the number of phase pulse signals that were emitted by the rotary input type of encoder 7 while the conveyor belt is further moved around this path of the driving roller. Since for the printed image length L, the measurement should be in meters or millimeters, another gauging or calibration must be done to that effect so that the length of the mentioned progressive movement section is measured in millimeters. This has been conventionally done by printing the L length known in exact millimeters of a test image on a sheet 1, and subsequently, for example, by means of a sensor, which detects the beginning of the image and the end of the image, determining how many phase pulse signals of the rotary input type of encoder 7 elapsed while the test image was moved past the mentioned sensor. The length L of the test image divided by the measured number of phase pulse signals thus results in the length of the progressive movement section in millimeters.

According to the invention, the detailed calibration of a test image is not necessary.

According to the invention, it is assumed that the length of a section, or preferably the overall, rotating conveyor belt 2 in its known gauge length is given in millimeters, and this overall length is measured in its number of phase pulse signals during a complete cycle of the conveyor belt which, by ratio formation then results in the measurement of an progressive movement section in millimeters or an appropriate conversion factor for converting from rotation angles into distance lengths is obtained.

Figure 3:
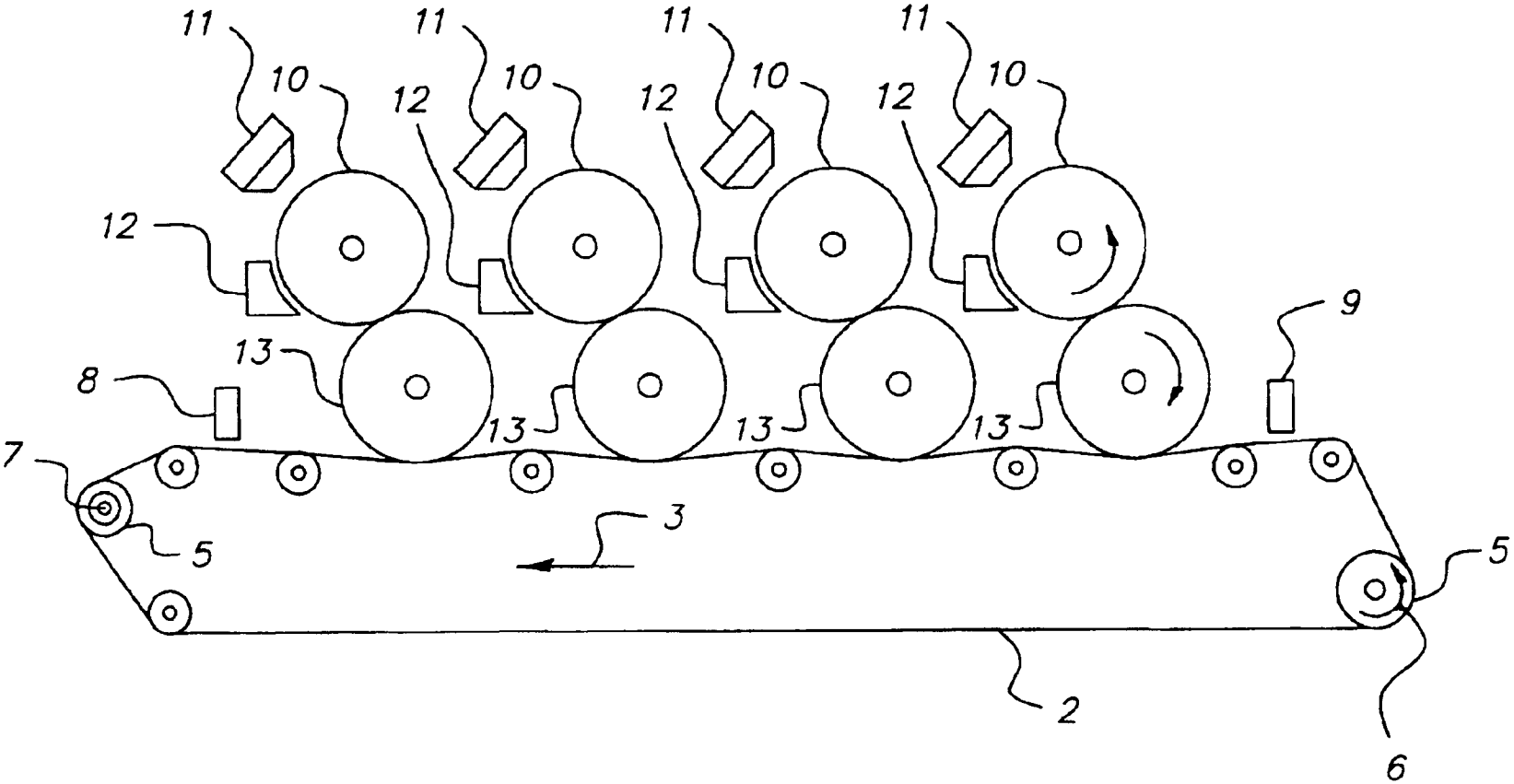
FIG. 3 is a schematic lateral view of the area of a conveyor belt, circulating in a closed loop, of an electrophotographic printing machine.

FIG. 3 shows a lateral schematic view of the area of an electrophotographically operating printing machine, in which a conveyor belt 2 for transporting print substrate is arranged and which circulates in a closed loop in the direction of the arrow 3.

The conveyor belt 2 runs over driving rollers 5, which rotate in the direction of arrow 6. In the area of one of the driving rollers 5, a rotary input type of encoder 7 is arranged, which is not shown in greater detail.

The arrival of a print substrate sheet on the conveyor belt 2, for example from a feed area, is detected with a sensor 9. Register marks (e.g., mark M in FIG. 1) on the sheet or on the conveyor belt 2 are detected with another sensor 8. Between sensors 8, 9, four printing devices above the conveyor belt 2 are schematically indicated as examples, whereby with the four printing devices, color separations for a four-colored print, for example, cyan, magenta, yellow and black can be applied electrophotographically on the print substrate. To this end, each of the printing devices comprises an electrophotographic imaging drum 10, a printhead 11 for the imaging of an imaging drum 10, a toner station 12 for applying toner on the imaged imaging drum 10 for the development of the image in question and a rubber blanket drum 13 to transfer the image developed onto the print substrate.

The invention has been described in detail with particular reference to certain preferred embodiments thereof, but it will be understood that variations and modifications can be effected within the spirit and scope of the invention.

What is claimed is:

1. Method for the calibration or recalibration of a conversion factor (web encoder resolution), used to determine the distance covered by a print substrate in a printing machine, in particular an electrophotographically operating printing machine, by means of the cycles of a rotary input type of encoder (web encoder) which sends a signal to the driver of a conveyor belt, preferably the rotation of a rotating drive component for the conveyor belt characterized in that the number of phase pulse signals of a rotating encoder are determined, which are accumulated during a movement of a section of the conveyor belt that is known in its longitudinal path or otherwise measured over the dimensions of its longitudinal distance and then compared and put into relation to the known longitudinal distance.

2. Method according to claim 1, characterized in that the number of phase pulse signals of the rotating encoder, which accumulate during a complete cycle of a closed loop forming conveyor belt, is determined and divided by the known or otherwise measured overall length of the conveyor belt.

3. Method according to claim 2, characterized in that a characteristic mark, either existing or applied to the conveyor belt, is used as a marker.

* * * * *